US007710348B2

(12) United States Patent
Taylor et al.

(10) Patent No.: US 7,710,348 B2
(45) Date of Patent: May 4, 2010

(54) FURLABLE SHAPE-MEMORY REFLECTOR

(75) Inventors: Robert Taylor, Superior, CO (US); Rory Barrett, Erie, CO (US); Phil Keller, Longmont, CO (US); Dana Turse, Broomfield, CO (US); Larry Adams, Arvada, CO (US)

(73) Assignee: Composite Technology Development, Inc., Lafayette, CO (US)

( * ) Notice: Subject to any disclaimer, the term of this patent is extended or adjusted under 35 U.S.C. 154(b) by 126 days.

(21) Appl. No.: 12/036,864

(22) Filed: Feb. 25, 2008

(65) Prior Publication Data

US 2009/0213031 A1 Aug. 27, 2009

(51) Int. Cl.
*H01Q 15/20* (2006.01)

(52) U.S. Cl. ..... 343/915; 343/914; 29/600

(58) Field of Classification Search ..... 343/914, 343/915, 912, 916; 29/600
See application file for complete search history.

(56) References Cited

U.S. PATENT DOCUMENTS

| | | | | | |
|---|---|---|---|---|---|
| 3,406,404 | A | * | 10/1968 | Maier | 343/915 |
| 3,978,490 | A | * | 8/1976 | Fletcher et al. | 343/882 |
| 4,030,103 | A | | 6/1977 | Campbell | |
| 4,613,870 | A | * | 9/1986 | Stonier | 343/915 |
| 4,646,102 | A | | 2/1987 | Akaeda et al. | |
| 4,926,181 | A | | 5/1990 | Stumm | |
| 5,446,474 | A | * | 8/1995 | Wade et al. | 343/915 |
| 5,488,383 | A | | 1/1996 | Friedman et al. | |
| 5,574,472 | A | | 11/1996 | Robinson | |
| 5,680,145 | A | | 10/1997 | Thomson et al. | |
| 5,700,337 | A | | 12/1997 | Jacobs et al. | |
| 5,787,671 | A | | 8/1998 | Meguro et al. | |
| 5,864,324 | A | | 1/1999 | Acker et al. | |
| 5,968,641 | A | | 10/1999 | Lewis | |
| 5,990,851 | A | | 11/1999 | Henderson et al. | |

(Continued)

FOREIGN PATENT DOCUMENTS

WO WO 03/018853 A2 3/2003

OTHER PUBLICATIONS

Composite Technology Development, Inc., "Rough Order Of Magnitude (ROM) Proposal For a 2.5-m Deployable Reflector for TacSat-4,"49 pages, Mar. 1, 2006.

(Continued)

*Primary Examiner*—HoangAnh T Le
(74) *Attorney, Agent, or Firm*—Townsend and Townsend and Crew LLP

(57) ABSTRACT

A shape-memory reflector is disclosed along with methods for manufacturing, packaging and deploying the same. The shape-memory reflector may include an elastic reflector material, a shape-memory stiffener, and a plurality of radial stiffeners. The shape-memory stiffener may be coupled with the elastic reflector material in a band that encloses at least a portion of the elastic reflector surface, for example, the exterior of a paraboloid reflector. The plurality of radial stiffeners is coupled with the bottom surface of the elastic reflector material and extends radially from a central portion of the elastic reflector surface toward the outer edge of the elastic reflector surface. The shape-memory reflector may be packaged in a packaged configuration that includes a plurality of pleats within the elastic reflector material and/or the shape-memory stiffener, and the shape-memory reflector is configured to deploy into a deployed configuration (i.e. a paraboloid) by heating the shape-memory stiffener.

21 Claims, 16 Drawing Sheets

U.S. PATENT DOCUMENTS

| | | | | |
|---|---|---|---|---|
| 6,104,358 | A | 8/2000 | Parker et al. | |
| 6,208,317 | B1 | 3/2001 | Taylor et al. | |
| 6,225,965 | B1 | 5/2001 | Gilger et al. | |
| 6,243,053 | B1 | 6/2001 | Shtarkman | |
| 6,278,416 | B1 | 8/2001 | Harless | |
| 6,313,811 | B1 | 11/2001 | Harless | |
| 6,344,835 | B1 | 2/2002 | Allen et al. | |
| 6,373,449 | B1 | 4/2002 | Bokulic et al. | |
| 6,384,800 | B1 | 5/2002 | Bassily et al. | |
| 6,441,801 | B1 | 8/2002 | Knight et al. | |
| 6,542,132 | B2 | 4/2003 | Stern | |
| 6,618,025 | B2 | 9/2003 | Harless | |
| 6,624,796 | B1 * | 9/2003 | Talley et al. | 343/915 |
| 6,702,976 | B2 | 3/2004 | Sokolowski | |
| 6,828,949 | B2 | 12/2004 | Harless | |
| 6,930,654 | B2 | 8/2005 | Schmid et al. | |
| 2007/0262204 | A1 | 11/2007 | Beidleman et al. | |
| 2008/0006353 | A1 | 1/2008 | Elzey et al. | |

OTHER PUBLICATIONS

Keller, Philip N. et al., "Development Of Elastic Memory Composite Stiffeners For A Flexible Precision Reflector," American Institute of Aeronautics and Astronautics, 11 pages, no date.

Lin, John K. H. et al., "Shape Memory Rigidizable Inflatable (RI) Structures For Large Space Systems Applications," 47th AIAA/ASME/ASCE/AHS/ASC Structures, Structural Dynamics and Materials Conference, 10 pages, May 1-4, 2006.

NASA, "Technical Support Package—Lightweight, Self-Deploying Foam Antenna Structures," NASA Tech Briefs NPO-30272, 3 pages, no date.

Tan, Lin Tze et al., "Stiffening Method for 'Spring-Back' Reflectors," Computational Methods for Shell and Spatial Structures, IASS-IACM 2000, 18 pages, 2000.

Abrahamson, Erik R. et al., "Shape Memory Mechanics of an Elastic Memory Composite Resin," Journal of Intelligent Material Systems and Structures, vol. 14, pp. 623-632, Oct. 2003.

Sokolowski, Witold M. et al., "Lightweight Shape Memory Self-Deployable Structures for Gossamer Applications," 45th AIAA/ASME/ASCE/AHS/ASC Structures, Structural Dynamics & Materials Conference, 10 pages, Apr. 19-22, 2004.

PCT International Search Report and Written Opinion mailed Apr. 30, 2009; International Application No. PCT/US2009/034394, 11 pages.

Barrett, Rory et al., "Deployable Reflectors for Small Satellites," 21st Annual Conference on Small Satellites, 2007, pp. 109.

PCT International Search Report and Written Opinion mailed Apr. 17, 2009, International Application No. PCT/US09/34397, 7 pages.

* cited by examiner

FURLABLE SHAPE-MEMORY REFLECTOR

BACKGROUND

This disclosure relates in general to shape-memory reflectors and, but not by way of limitation, to shape-memory reflectors utilizing shape-memory polymers among other things.

Space antennas are designed to provide reliable RF energy reflection to a feed located at the focus of the antenna's energy collecting surface. A deployable space antenna, therefore, should likewise supply the same RF energy reflection while providing an antenna that is launched in a packaged configuration and deployed as a reflector that exceeds the size of the packaged configuration. A deployable antenna should be light weight, have a small stowage to deployment volumetric ratio, has a solid reflector surface, and be as simple as possible to deploy.

BRIEF SUMMARY

A shape-memory reflector is provided according to one embodiment of the disclosure. The shape-memory reflector may include an elastic reflector material, a shape-memory stiffener, and a plurality of radial stiffeners. The shape-memory stiffener may be coupled with the elastic reflector material in a band that encloses at least a portion of the elastic reflector surface, for example, the exterior of a paraboloid reflector. Each of the plurality of radial stiffeners are coupled with the bottom surface of the elastic reflector material and extend radially from a central portion of the elastic reflector surface toward the outer edge of the elastic reflector surface. The shape-memory reflector may be packaged in a packaged configuration that includes a plurality of reversing bends within the elastic reflector material and/or the shape-memory stiffener, and the shape-memory reflector is configured to deploy into a deployed configuration (i.e. a paraboloid) by heating the shape-memory stiffener.

The shape-memory stiffener(s) may include a shape-memory polymer having a glass transition temperature ($T_g$) that is less than a survival temperature of the shape-memory polymer. The shape-memory stiffener may also include a top and bottom face sheet. One of the top and bottom face sheets may be a portion of the elastic reflector material. The elastic reflector material may comprise a thin laminate material and/or a graphite composite material. The radial stiffeners may comprise a solid material and/or a laminate material. Heaters may also be coupled with the shape-memory stiffener.

A method for packaging a shape-memory reflector is also provided according to another embodiment of the disclosure. The shape-memory reflector may be initially fabricated in a deployed configuration and includes a paraboloid-shaped elastic reflector coupled with a band of shape-memory polymer at a circumference of the elastic reflector and a plurality of radial stiffeners. The method may include heating the shape-memory polymer to a temperature above $T_g$ of the shape-memory polymer and applying mechanical loads to the shape-memory reflector such that the mechanical loads deform the shape-memory reflector into a packaged configuration. The shape-memory stiffener may then be cooled to a temperature below $T_g$ of the shape-memory polymer following which the mechanical loads may be removed.

A method for deploying a shape-memory reflector is also disclosed according to another embodiment. The shape-memory reflector includes a paraboloid-shaped elastic reflector coupled with a shape-memory polymer at a circumference of the elastic reflector and a plurality of radial stiffeners, and the shape-memory reflector is packaged in a packaged configuration. The shape-memory polymer is heated to a temperature above $T_g$ of the shape-memory polymer. Once heated, the shape-memory reflector is allowed to return to a deployed configuration, such as, a paraboloid shape. The shape-memory polymer may then be cooled to a temperature below $T_g$ of the shape-memory polymer.

A method for manufacturing a paraboloid shape-memory reflector is also provided according to another embodiment. A thin elastic reflector material is provided to form a paraboloid. The elastic reflector material includes a top surface at the concave side on the elastic reflector material and a bottom surface on the convex side of the elastic reflector material. Radial stiffeners are then coupled to the bottom surface of the elastic reflector material and positioned radially about the center of the elastic reflector material. A shape-memory polymer is then coupled with the elastic reflector material at a circumference of the elastic reflector material. The circumference may enclose at least a portion of the elastic reflector material centered about the center of the elastic reflector material.

Further areas of applicability of the present disclosure will become apparent from the detailed description provided hereinafter. It should be understood that the detailed description and specific examples, while indicating various embodiments, are intended for purposes of illustration only and do not limit the scope of the disclosure.

In the appended figures, similar components and/or features may have the same reference label. Where the reference label is used in the specification, the description is applicable to any one of the similar components having the same reference label.

DETAILED DESCRIPTION

The ensuing description provides preferred exemplary embodiment(s) only, and is not intended to limit the scope, applicability or configuration of the disclosure. Rather, the ensuing description of the preferred exemplary embodiment(s) will provide those skilled in the art with an enabling description for implementing a preferred exemplary embodiment. It should be understood that various changes may be made in the function and arrangement of elements without departing from the spirit and scope as set forth in the appended claims.

Embodiments of the present disclosure are directed towards a shape-memory reflector. The shape-memory reflector may be adapted for space communication applications. The shape-memory reflector may be prepared and launched in a packaged configuration that requires little or no mechanical devices to secure the reflector during launch. Once in space, the shape-memory reflector may be deployed with little or no moving parts. The shape-memory reflector may be parabolic shaped in a deployed configuration and stowed in a packaged configuration that is somewhat cylindrical-shaped. The shape-memory reflector may include a surface of substantially continuous, elastic reflector material. For example, the elastic reflector material may comprise a laminate of composite polymer layers.

The shape-memory reflector may include a shape-memory stiffener that is used to actuate the reflector from the packaged configuration to the deployed configuration when heated above $T_g$. The shape-memory stiffener may include a sandwich of flexible face sheets around a core of shape-memory material, for example, a shape-memory polymer and/or foam. One of the flexible face sheets may include the reflector material. The shape-memory stiffener may be attached circumferentially on the reflector material. In one embodiment, the shape-memory stiffener may be attached circumferentially with the exterior circumference of the reflector material. In another embodiment, the shape-memory stiffener may be attached circumferentially with various other circumferences of the reflector material with a radius less than or equal to the radius of the paraboloid.

In various embodiments, the shape-memory reflector may also include a plurality of radial stiffeners that are, for example, radially attached with the back surface of the reflector material. The radial stiffeners may extend from a central portion of the reflector material and extend outwardly toward the exterior edge of the reflector material. In one embodiment, when the shape-memory reflector is stowed in its packaged configuration, the radial stiffeners may define bend locations within the reflector material in the package configuration.

Figure 1:
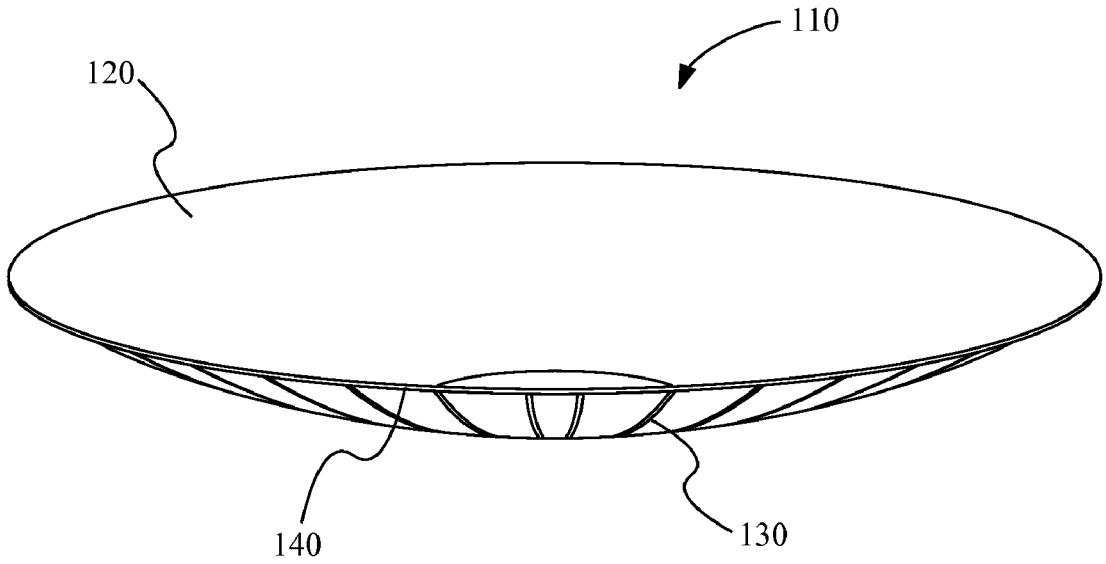
FIG. 1 shows a three-dimensional shape-memory reflector in a deployed configuration according to one embodiment.

FIG. 1 shows a three-dimensional shape-memory reflector 110 in a deployed configuration according to one embodiment. The shape-memory reflector 110, in this embodiment, is deployed in a paraboloid shape for directing energy to and/or from the focus at the centerline of the reflector. Various other deployed configurations and/or shapes may also be used. The shape-memory reflector 110 includes a substantially continuous reflector material 120. The reflector material 120 may include a graphite-composite laminate with between one and six plies. Various other materials such as thin metallic membranes, epoxy films, or other laminates may be used. The laminates may include various thicknesses. The reflector material 120 may be formed on a parabolic mandrel during manufacture. The reflector material 120 may be an elastic material that is stiff in its plane and relatively flexible in bending. The reflector material may be thin enough to bend to a radius of a few inches without permanent deformation.

Figure 2A:
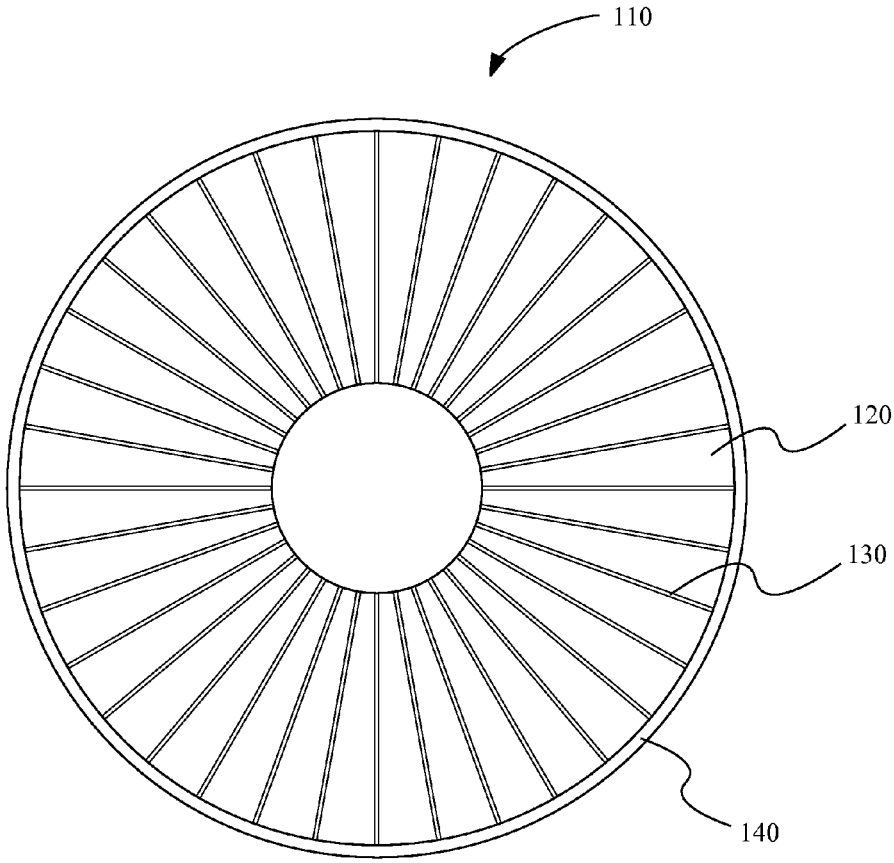
FIG. 2A shows a back view of a shape-memory reflector in a deployed configuration according to one embodiment.
Figure 2B:
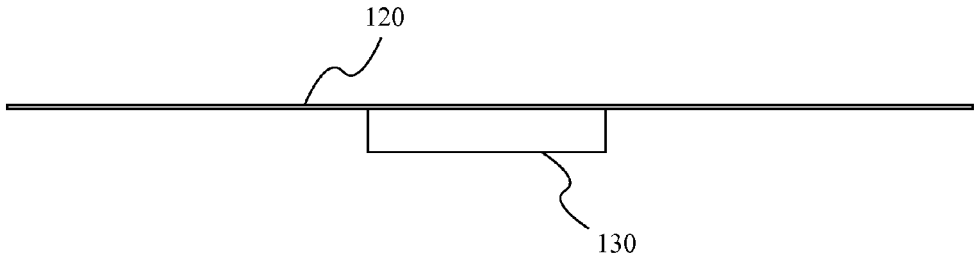
FIG. 2B shows a cross-section of a radial stiffener according to one embodiment.

FIG. 2A shows a back view of a shape-memory reflector 110 in a deployed configuration according to one embodiment. This view shows the convex side of the shape-memory reflector 110. As can be seen, the shape-memory reflector may include a plurality of radial stiffeners 120 arrayed radially around a central portion of the shape-memory reflector 110. The shape-memory reflector may also include a band of shape-memory material 140 shown at the edge of the shape-memory reflector 110. FIG. 2B shows a cross section of a radial stiffener according to one embodiment.

The radial stiffeners 130 may be radially equidistant from each other or in any other configuration and may be attached to the convex side of the reflector material 120 in the deployed state. The radial stiffeners 130 may comprise a thicker layer of solid material, such as the same material as the reflector material 120. The radial stiffeners 130 may also comprise plies of graphite composite laminate co-cured with the reflector material 120 during fabrication, or the radial stiffeners 130 may also comprise a strip of composite or other material secondarily bonded to the reflector material 120. The cross section of the radial stiffener may be rectangular, as shown in FIG. 2B, or any other shape, for example, a trapezoid formed by stacking narrower plies of composite on a wider base.

In one embodiment, the radial stiffeners 130 may be continuous, flexible, but non-collapsible sections. The radial stiffeners 130 may provide sufficient stiffness and dimensional stability in the deployed state so as to maintain the paraboloid shape of the reflective surface. The radial stiffeners 130 may also include sufficient flexibility in bending to enable them to be straightened during packaging. The radial stiffeners may also have sufficient strength longitudinally to react to radial tensile loads in the reflective surface that are applied during packaging. And, the radial stiffeners 130 may have sufficient local strength to provide mounting locations for launch support structures and packaging loads.

The shape-memory reflector 110 may also include a shape-memory stiffener 140. The shape-memory stiffener 140, for example, may include any shape-memory material described in commonly assigned U.S. patent application Ser. No. 12/033,584, filed 19 Feb. 2008, entitled "Highly Deformable Shape-memory Polymer Core Composite Deformable Sandwich Panel," which is herein incorporated by reference for all purposes. In one embodiment, the shape-memory stiffener 140 comprises a sandwich including a first face sheet, a shape-memory core and a second face sheet. The first and second face sheets may include laminates or layers of composite material. In one embodiment, the reflector material 120 may comprise the first face sheet. The second face sheet may include the same material as the reflector material and may be coupled therewith. The shape-memory core may comprise shape-memory polymer foam. The shape-memory stiffener 140 may be located on the outer edge of the paraboloid surface as shown or may be located at the reflector material surface at any radius inward to the inside edge of a center hole in the parabolic surface. Multiple circumferential shape-memory stiffeners may be used at different radii.

Figure 3A:
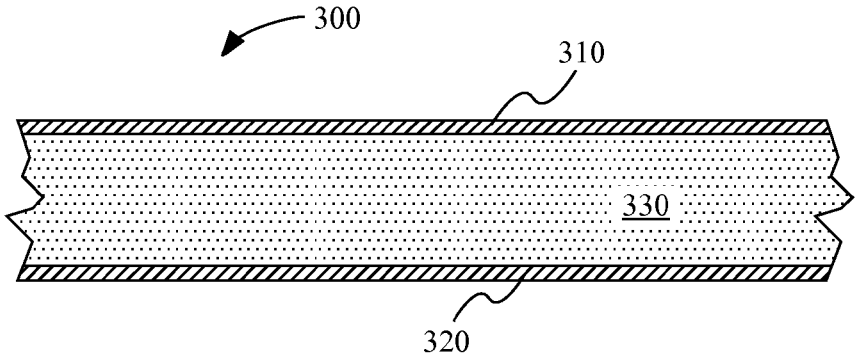
FIG. 3A shows a cross section of a shape-memory stiffener according to one embodiment.

FIG. 3A shows a cross section of a portion of an exemplary shape-memory stiffener 300 according to one embodiment. This shape-memory stiffener 300 may be fabricated into a continuous band that is attached to the convex surface of the reflector shown in FIG. 1 according to one embodiment. In another embodiment, the shape-memory stiffener 300 may also be fabricated with a plurality of discrete shape-memory cores 330 or a band that includes discrete pieces of shape-memory core 330 coupled together to form a band. The shape-memory stiffener 300 may include a first face sheet 310, a second face sheet 320 and a shape-memory core 330. The first and/or second face sheets 310, 320 may comprise the same material or similar material as the reflector material 120. The shape-memory core 330 may be in substantially continuous contact with both the first face sheet 310 and the second face sheet 320. That is, the core is not segmented, but instead is in mostly continuous contact with the surface of both face sheets. For example, the shape-memory core 330 may be in continuous contact with about 75%, 80%, 85%, 90%, 95% or 100% of either and/or both the first face sheet 310 and the second face sheet 320. In some cases, however, the core 330 may comprise a plurality of discrete shape-memory cores coupled together.

The first and/or second face sheets 310, 320 may comprise a thin metallic material according to one embodiment. In other embodiments, the face sheets may include fiber-reinforced materials. The face sheets may also comprise a composite or metallic material. The face sheets may also be thermally conductive. The shape-memory core 330 may comprise a shape-memory polymer and/or epoxy, for example, a thermoset epoxy. The shape-memory core 330 may also include either a closed or open cell foam core. The shape-memory core 330 may be a polymer foam with a $T_g$ lower than the survival temperature of the material. For example, the shape-memory core may comprise TEMBO® shape-memory polymers, TEMBO® foams or TEMBO® elastic memory composites.

Figure 3B:
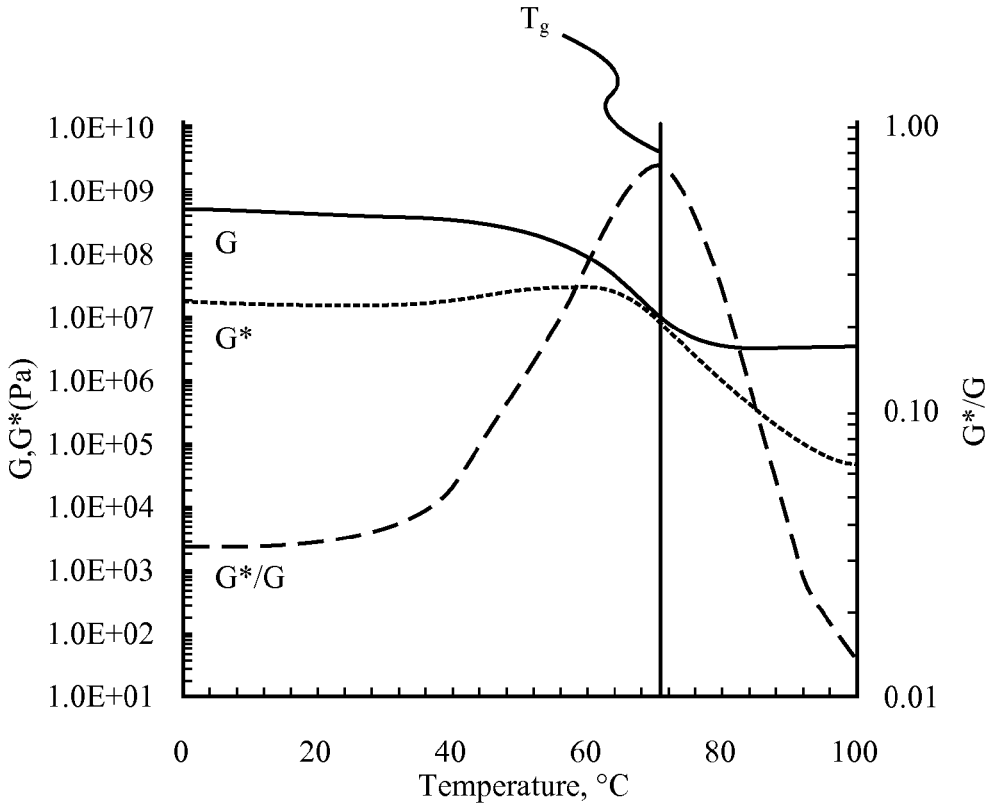
FIG. 3B shows a graph of the shear modulus G, the complex shear modulus G*, and the ratio of the shear modulus to the complex shear modulus G*/G of an exemplary shape-memory material according to one embodiment.

FIG. 3B shows a graph of the shear modulus G, the complex shear modulus G*, and the ratio of the shear modulus to the complex shear modulus G*/G of an exemplary shape-memory material according to one embodiment. The peak in the G*/G curve is defined as the glass transition temperature ($T_g$) of the shape-memory material. Above $T_g$, glasses and organic polymers become soft and capable of plastic deformation without fracture. Below $T_g$, the joining bonds within the material are either intact, or when cooling increase as the material cools. Thus, below $T_g$, materials often become stiff, brittle and/or strong.

The shape-memory stiffener 140 may be a continuous shape-memory sandwich as just described. The shape-memory stiffener 140 may also include a plurality of shape-memory elements coupled together on the surface of the reflector element. The shape-memory stiffener may be a collapsible, yet strong and stiff shape-memory polymer based stiffener. The shape-memory stiffener 140 may have sufficient stiffness and dimensional stability in the deployed state (at temperatures below $T_g$) so as to maintain the paraboloid shape of the reflective surface. Moreover, the shape-memory stiffener 140 may have sufficient strain and strain energy storage capability at temperatures above $T_g$ to allow packaging the reflector without to damage to the reflective surface. The shape-memory stiffener 140 may also include sufficient stiffness and dimensional stability in the packaged state, at temperatures below $T_g$, so as to maintain the packaged shape of the reflector without extensive launch locks. Also, the shape-memory stiffener 140 may include sufficient dampening during actuation at temperatures above $T_g$ to effectively control un-furling of the reflective surface.

Figure 4A:
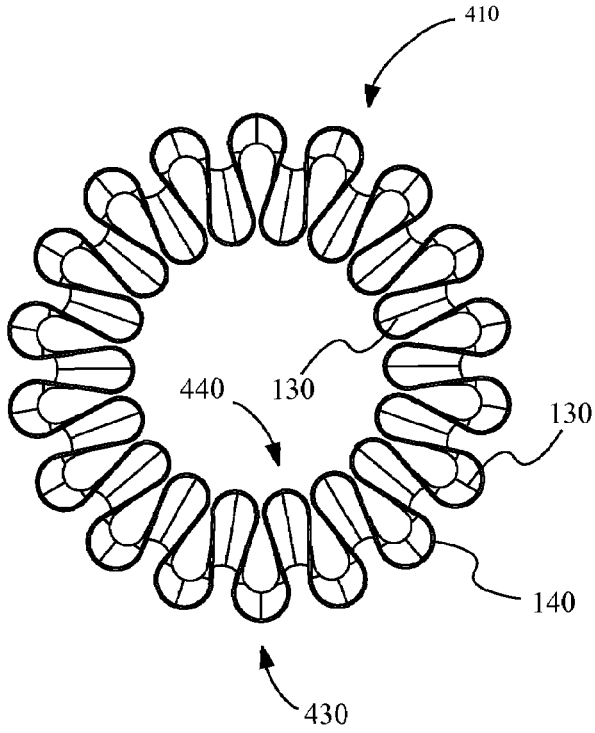
FIGS. 4A and 4B show a top view and a side view of a packaged shape-memory reflector according to one embodiment.
Figure 4B:
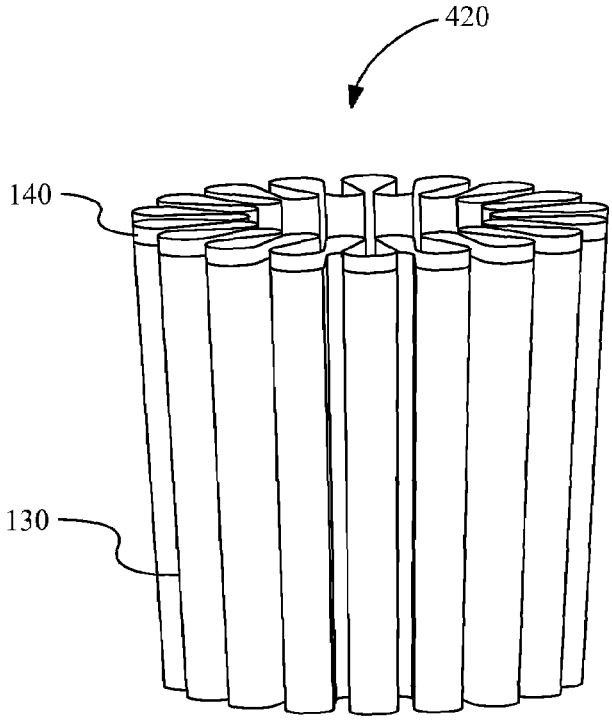

FIGS. 4A and 4B show a top view 410 and a side view 420 of a packaged shape-memory reflector according to one embodiment. The packaged shape-memory reflector is packaged such that the shape-memory stiffener 140 is curved into reversing bends with the peak and valley of each bend occurs near a radial stiffener 130. The packaging is initiated by bending every other radial stiffener 130 inward, creating a roughly conical shape to the parabolic surface and stabilizing the location of a plurality of pleats in the material. The reflector may be packaged by drawing the outside of the reflector inward, forcing the pleats to become deeper and the shape-memory stiffener 140 to wrap into reversing bends. At the inside edge of the reflector, the radius would also be decreased, resulting in pleats extending from inside edge to outside edge. The shape-memory reflector may be packaged when the shape-memory stiffener(s) 140 is heated to a temperature greater than $T_g$ of the shape-memory core. Once in the packaged configuration, the shape-memory stiffener(s) is cooled to a temperature below $T_g$ allowing the shape-memory stiffener to carry mechanical loads and maintain the shape of the packaged reflector.

Figure 5:
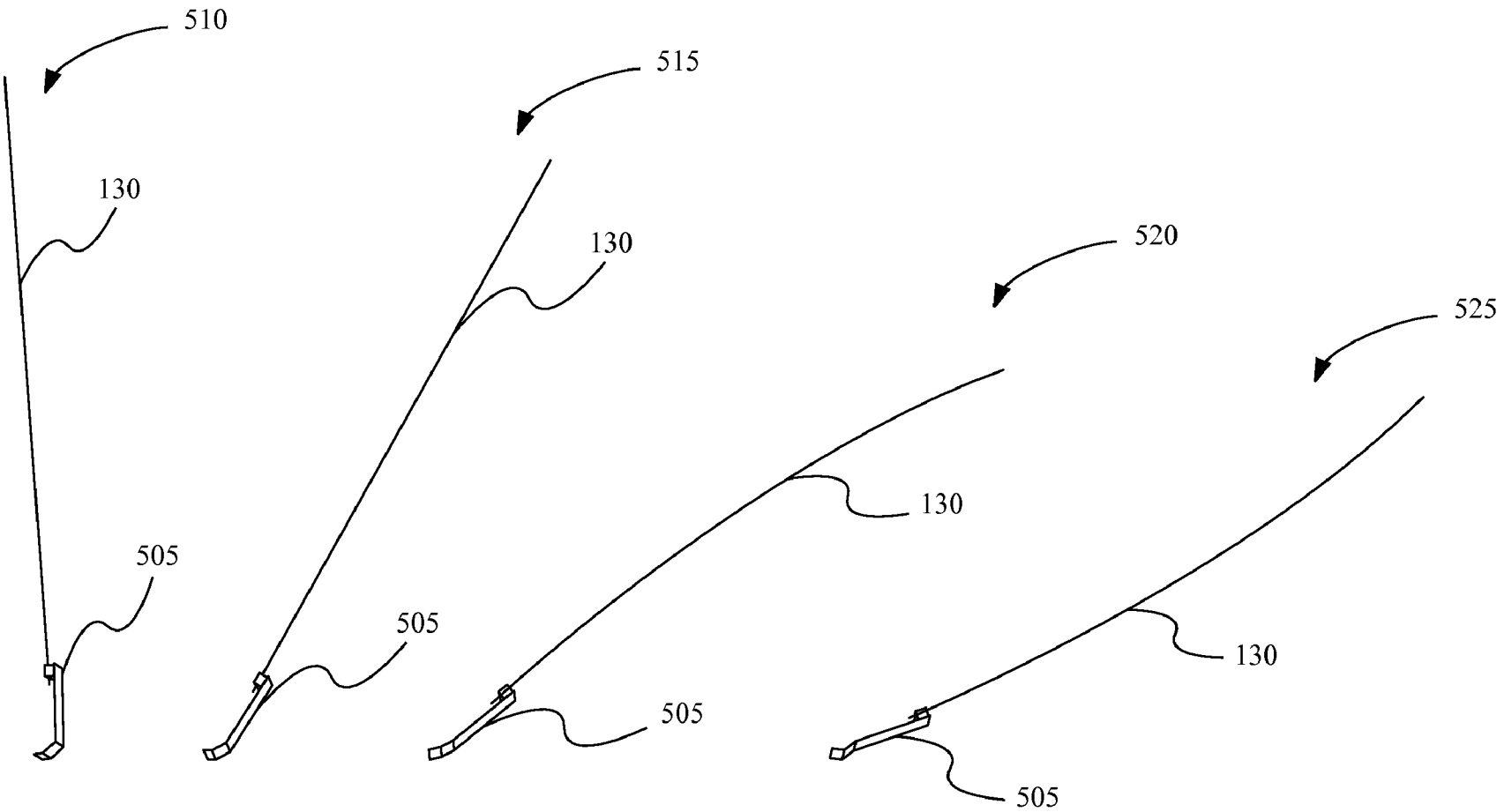
FIG. 5 shows mechanical linkages attached with radial stiffeners according to one embodiment.
Figure 6A:
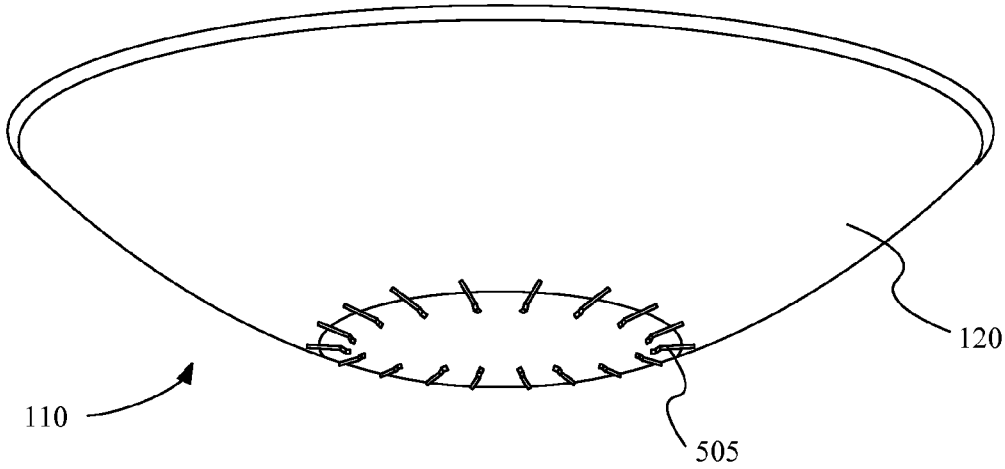
FIGS. 6A and 6B show a three-dimensional view of a deployed and packaged shape-memory reflector according to one embodiment.
Figure 6B:
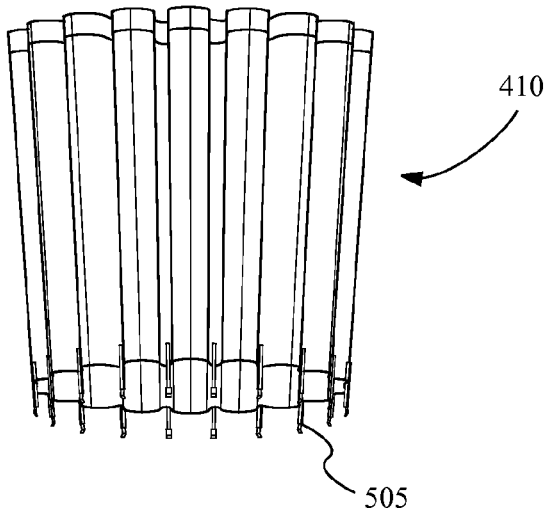

FIG. 5 shows mechanical linkages 505 attached with radial stiffeners 130 according to one embodiment. As shown in the figure, the mechanical linkage 505 is in the packaged configuration at 510. Note that the radial stiffener 130 is nearly straight and in the vertical position when packaged. At 525, the mechanical linkage 505 is in the deployed configuration and the radial stiffener 130 is in a parabolic shape as shown. Positions 515 and 520 show the mechanical linkage 505 and radial stiffener 130 in between the packaged 510 and deployed configurations 525. Between position 515 and 520, pressure is applied to the mechanical linkage 505, which applies the appropriate pressure on the stiffener to reverse the bend in the stiffener. As shown in FIGS. 6A and 6B, the mechanical linkages 505 may be provided to connect the interior edge of a deployed reflector 120 to a central hub. These mechanical linkages 505 may provide, for example, a rigid attachment between the reflector surface 120 and a spacecraft to which the reflector is mounted. The mechanical linkages 505, for example, may also aid in controlling the packaging and deployment kinematics of the interior edge of the reflector surface 120 so as to minimize packaging strains and/or avoid non-uniform motion and material failure within the interior region during packaging and deployment.

During packaging and/or deployment, these mechanical linkages 505 may provide a fixed point of rotation radially inward from the interior edge of the reflector surface 120 about which the interior region of the reflector rotates during packaging and deployment. The location of this fixed point of rotation is defined far enough inside the edge of the reflector to reduce packaging strains within the reflector 110. A mechanical linkage 505 may be located at each pleat in the packaged reflector or at some integer subset of pleats, for example, every other pleat, etc. By locating the fixed point of rotation behind the parabolic surface 120, the inner hole of the reflector 110 can be filled with a solid, stationary parabolic reflective surface.

Figure 7A:
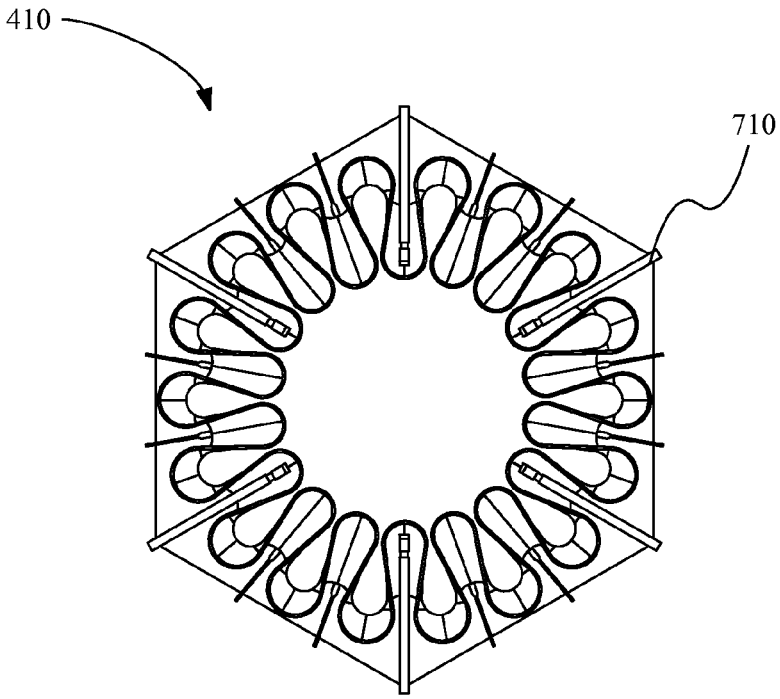
FIGS. 7A and 7B show a front and top view of a packaged reflector shell within a backing structure according to one embodiment.
Figure 7B:
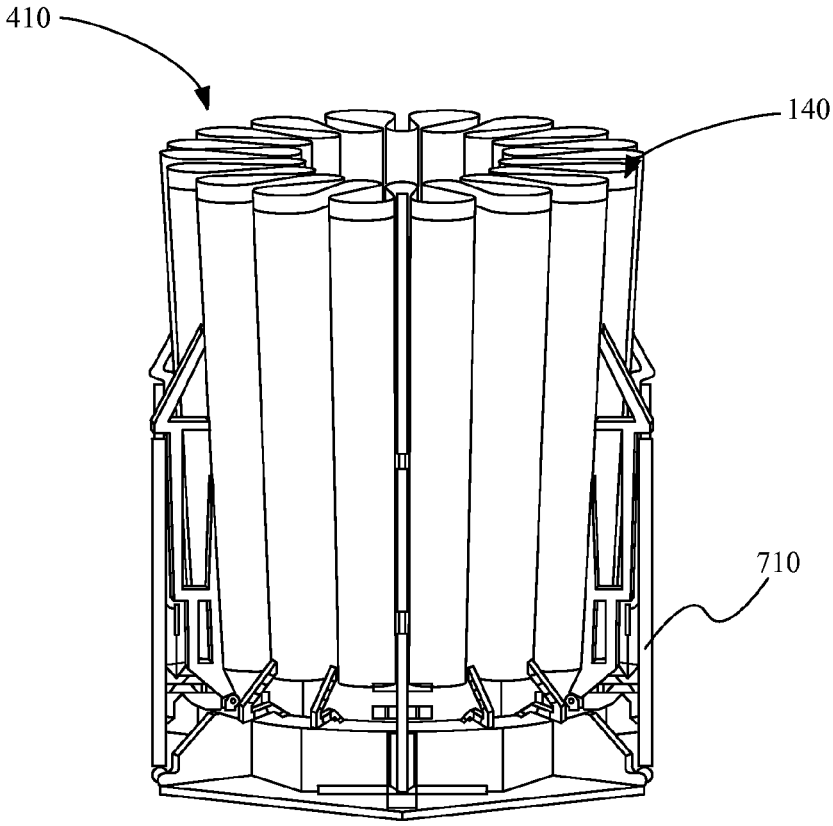
Figure 8:
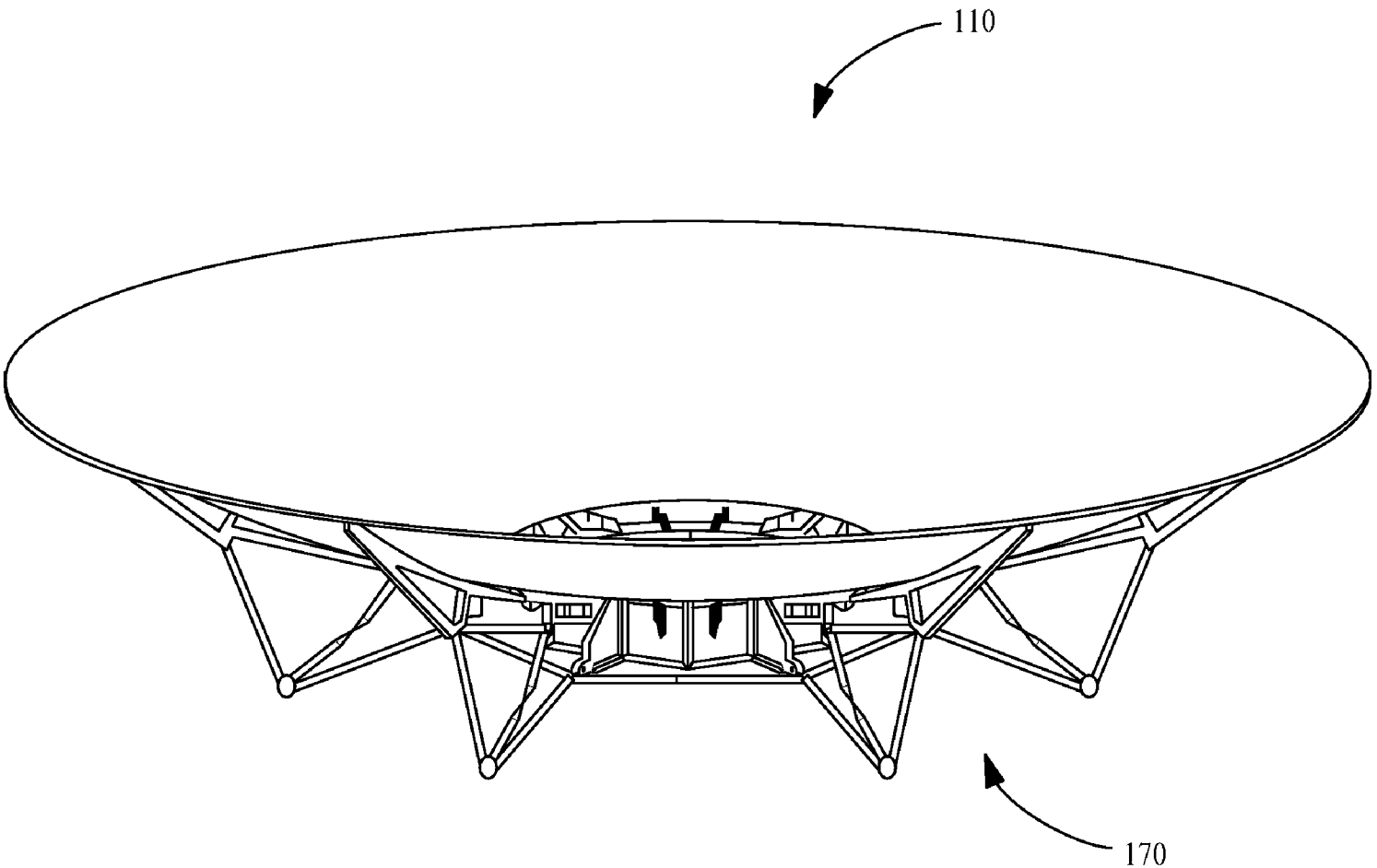
FIG. 8 shows a front view of a deployed reflector shell and backing structure according to one embodiment.

FIGS. 7A and 7B show a front and top view of a packaged reflector shell within a backing structure 710 according to one embodiment. FIG. 8 shows a deployed reflector 110 with a backing structure 710. The backing structure 710 may provide deployed stiffness and/or dimensional accuracy. Moreover, the reflector may be attached to, and supported by, the backing structure 710. The backing structure may include a number of radial arms that pivot inward for packaging and deployable truss elements to lock the arms into the deployed position. Each deployable arm may be attached to a central hub and/or a single radial position on the reflector. In addition, the inside bend of every pleat in the reflector surface is attached by a mechanical linkage to a pivot point on the same central hub. In the example shown, there are 6 arms attached to the outside edge and 18 pleats with 18 linkages at the inside edge of the reflector. Alternate embodiments could use a different number of pleats and/or a different number of arms. The arms could be attached to the radial elements inside of the outer edge, the reflector could be attached to only the linkages at the inside edge, the linkages could be at fewer than every pleat, or the arms could be at every pleat. Also, the arms could lock-out and provide stiffness and dimensional stability with various mechanical means, for example, rotation stops, linear or rotary springs, detent pins, and flexures.

Figure 9:
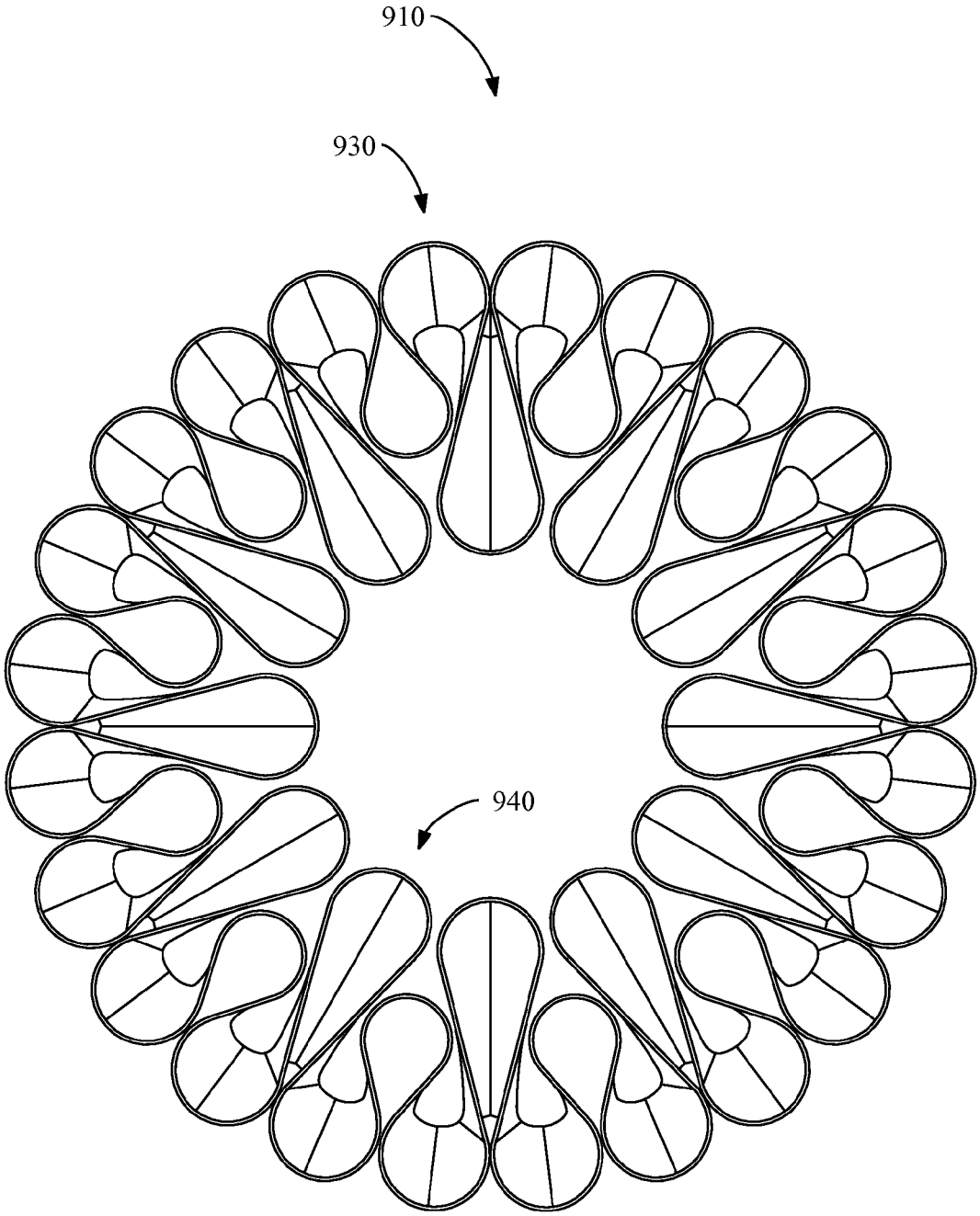
FIG. 9 shows a top view of a packaged shape-memory polymer reflector that includes both large and small pleats according to one embodiment.

FIG. 9 shows a top view of a packaged shape-memory polymer reflector that includes both large pleats 940 and small pleats 930 according to one embodiment. Packaging the reflector with larger and smaller pleats may allow for a more efficient package in a smaller circular space. For example, this allows the same reflector to be packaged into about a 25% smaller diameter packaging envelope.

According to another embodiment, the reflector could be packaged with drastically fewer pleats. For example, the reflector could be packaged with just 2 pleats forming a taco-shaped package. The circumferential stiffener would still serve to retain the stowed condition diagonals between the radial elements could be added since local curvature would be very low.

Figure 10:
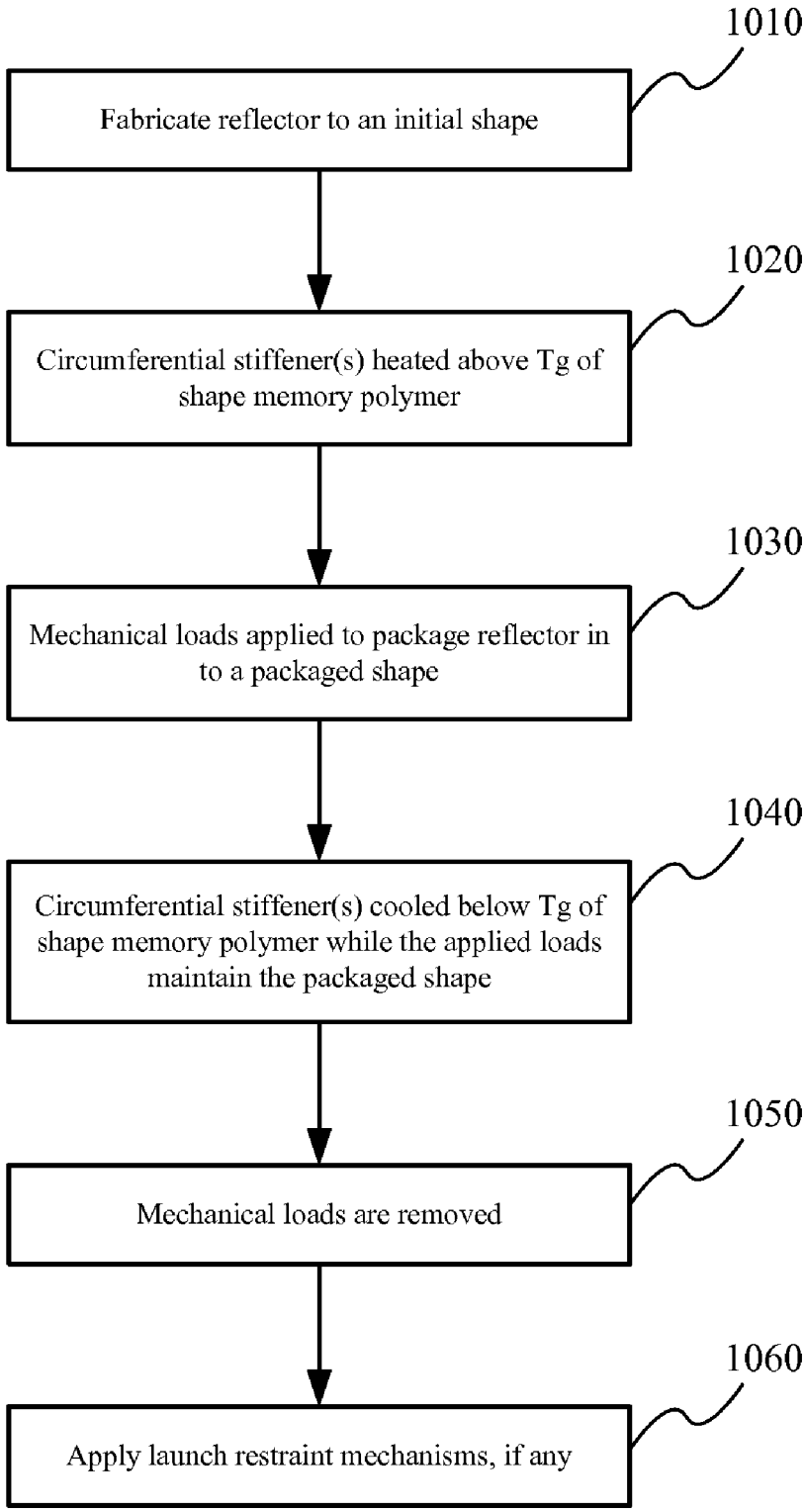
FIG. 10 shows a flowchart of a method for packaging a shape-memory reflector according to one embodiment.

FIG. 10 shows a flowchart of a method for packaging a shape-memory reflector according to one embodiment. At block 1010, the reflector is fabricated with an initial deployed shape. The reflector may also be fabricated with shape-memory stiffener or stiffeners and a plurality of radial stiffeners. This deployed configuration may provide a minimum strain energy shape for the reflector. At block 1020, the shape-memory stiffener or stiffener(s) is heated to a temperature above $T_g$ of the shape-memory polymer within the shape-memory stiffener. At block 1030, mechanical loads are applied to deform reflector into a packaged shape, such as, for example, the packaged shape shown in FIG. 4B. At block 1040 the shape-memory stiffener(s) is cooled to a temperature below $T_g$ of the shape-memory polymer while the packaged shape is maintained with the applied loads. Following which, at block 1050, the mechanical loads are removed and the shape-memory stiffener maintains its packaged shape due to strain energy storage in the cooled shape-memory polymer core. The reflector will remain in its packaged condition with minimal or no external loads until deployment. The pleats are stabilized for launch loading by bending stiffness of packaged circumferential stiffener. In some applications, launch restraint mechanisms may be applied at block 1060.

Figure 11:
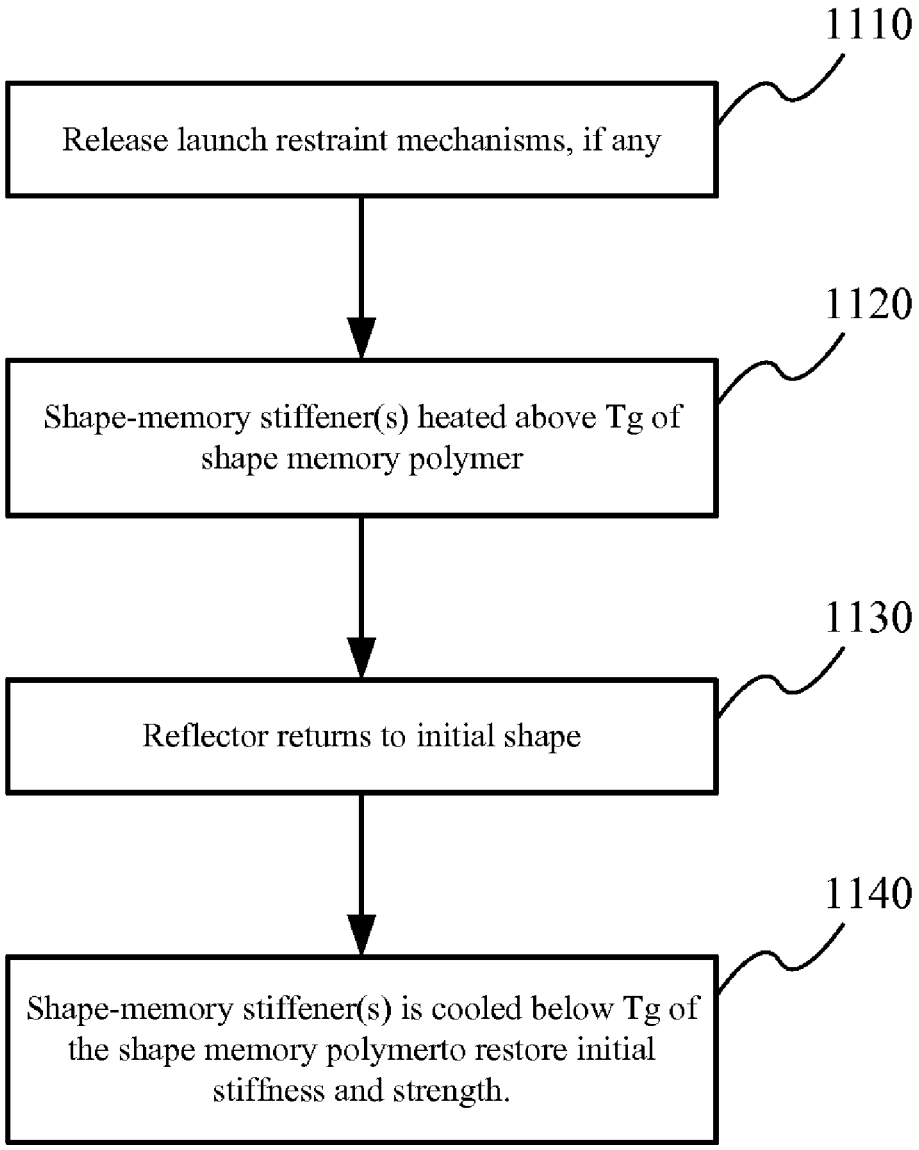
FIG. 11 shows a flowchart of a method for deploying a shape-memory reflector according to one embodiment.

FIG. 11 shows a flowchart of a method for deploying a shape-memory reflector according to one embodiment. At block 1110, launch restraints, if any, are released. The shape-memory stiffener(s) is heated to a temperature above $T_g$ of the shape-memory polymer within the shape-memory stiffeners. During this heating, the shape-memory stiffener(s) straightens out of reversing bends, allowing the reflector to return to its initial paraboloid shape with minimal or no external mechanical loads at block 1130. At block 1140, the shape-memory stiffener is cooled to a temperature below $T_g$ of the shape-memory polymer. The initial stiffness and strength of the shape-memory polymer is restored upon cooling.

Figure 12A:
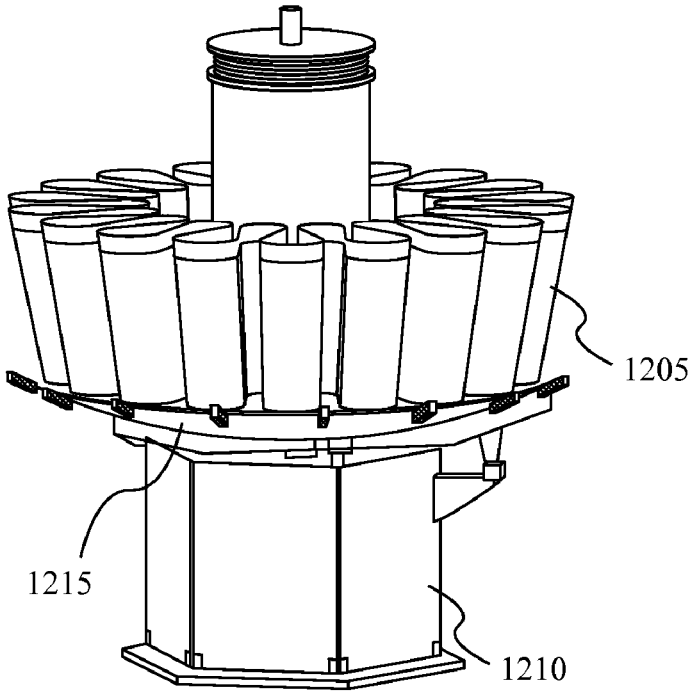
FIGS. 12A and 12B show a packaged and deployed shape-memory reflector coupled with a satellite according to another embodiment.
Figure 12B:
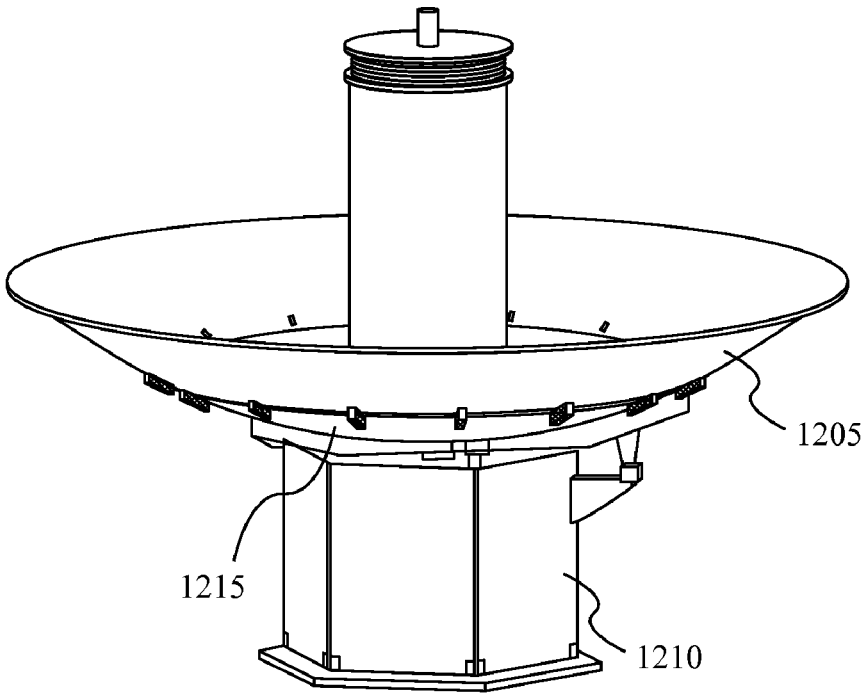

FIGS. 12A and 12B show a packaged and deployed shape-memory reflector coupled with a non-deployable, centrally located reflector 1215, which is, in turn, mounted on of a satellite according to another embodiment. The packaged reflector 1205 as shown in this example, is mounted on a satellite payload module 1210.

Figure 13A:
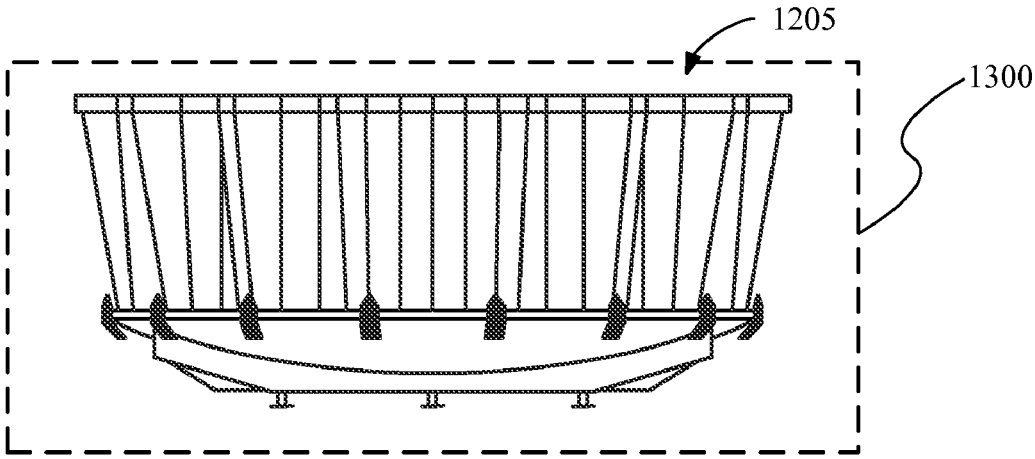
FIGS. 13A and 13B show a top and side view of a packaged shape-memory reflector within a clearance to launch envelope according to another embodiment.
Figure 13B:
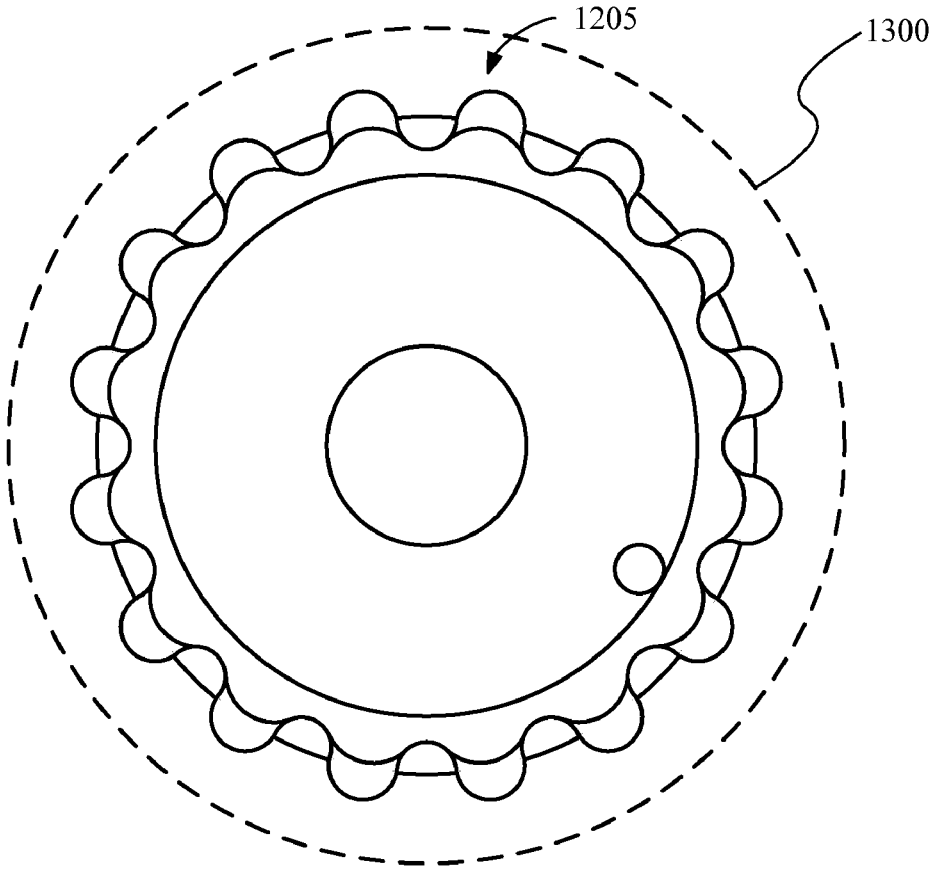

As shown in FIGS. 13A and 13B, the packaged shape-memory reflector 1205 may be stowed in a small volume 1300, for example, for space applications. A reflector 1205 may be stowed during launch and deployed in space. A top view and side view of a packaged shape-memory reflector 1205 within it's clearance to launch envelope 1300 is shown in FIGS. 13A and 13B according to another embodiment. In this embodiment, the deployable shape-memory reflector 1205 could be designed such that, in its packaged state, it does not substantially shadow the non-deployable central reflector, which would enable this reflector to be used prior to deployment of the packaged shape-memory reflector.

Figure 14:
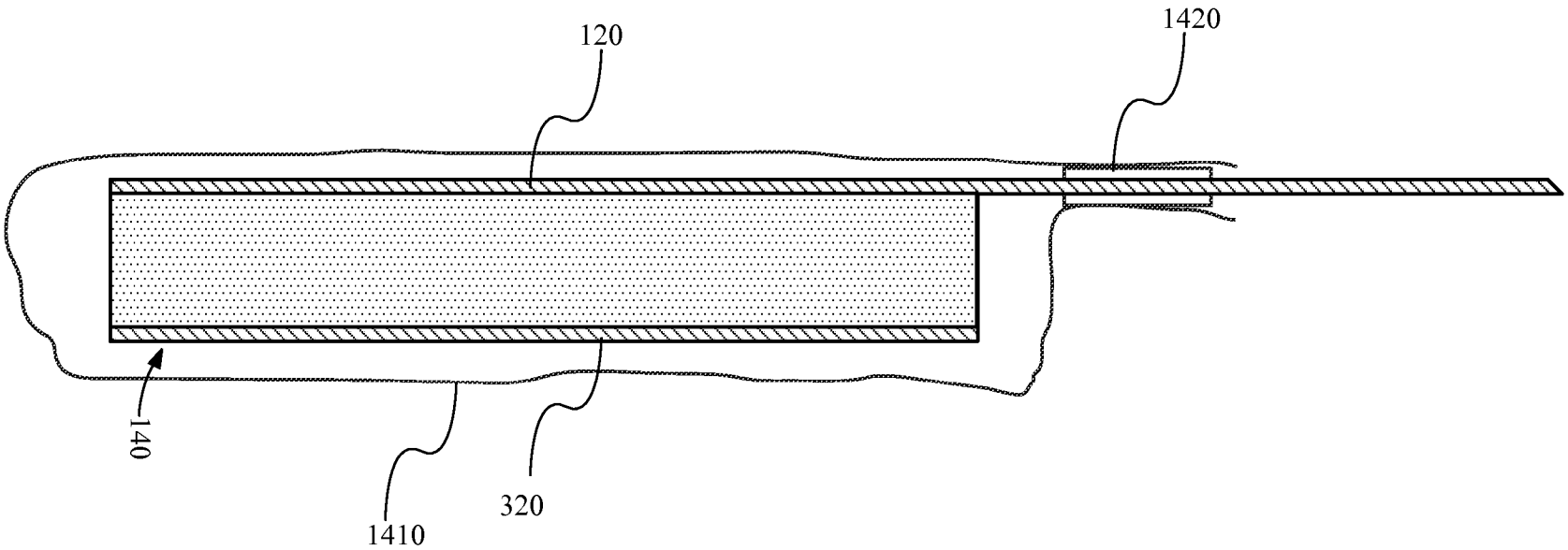
FIG. 14 shows a cut away view of a circumferential shape-memory polymer coupled with an elastic reflector material according to one embodiment.

FIG. 14 shows a cut away view of a shape-memory stiffener 140 coupled with an elastic reflector material 120 according to one embodiment. The shape-memory stiffener 140 is enclosed within a protective covering 1410, such as, for example, multi-layer insulation (MLI). The MLI may be coupled with the elastic reflector material 120 using any of various adhesives 1420. Note that, in this embodiment, the shape-memory stiffener 140 is coupled with the elastic reflector material 120. Indeed, the elastic reflector material 120 comprises one of the face sheets of the shape-memory stiffener 140.

Figure 15:
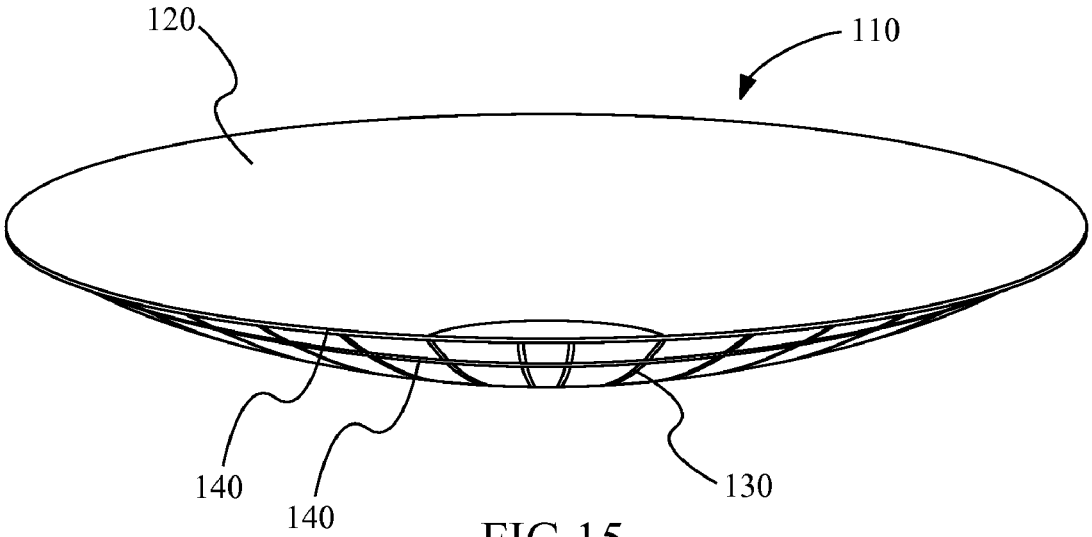
FIG. 15 shows a three-dimensional view of a shape-memory reflector with two shape-memory stiffener according to another embodiment.
Figure 16:
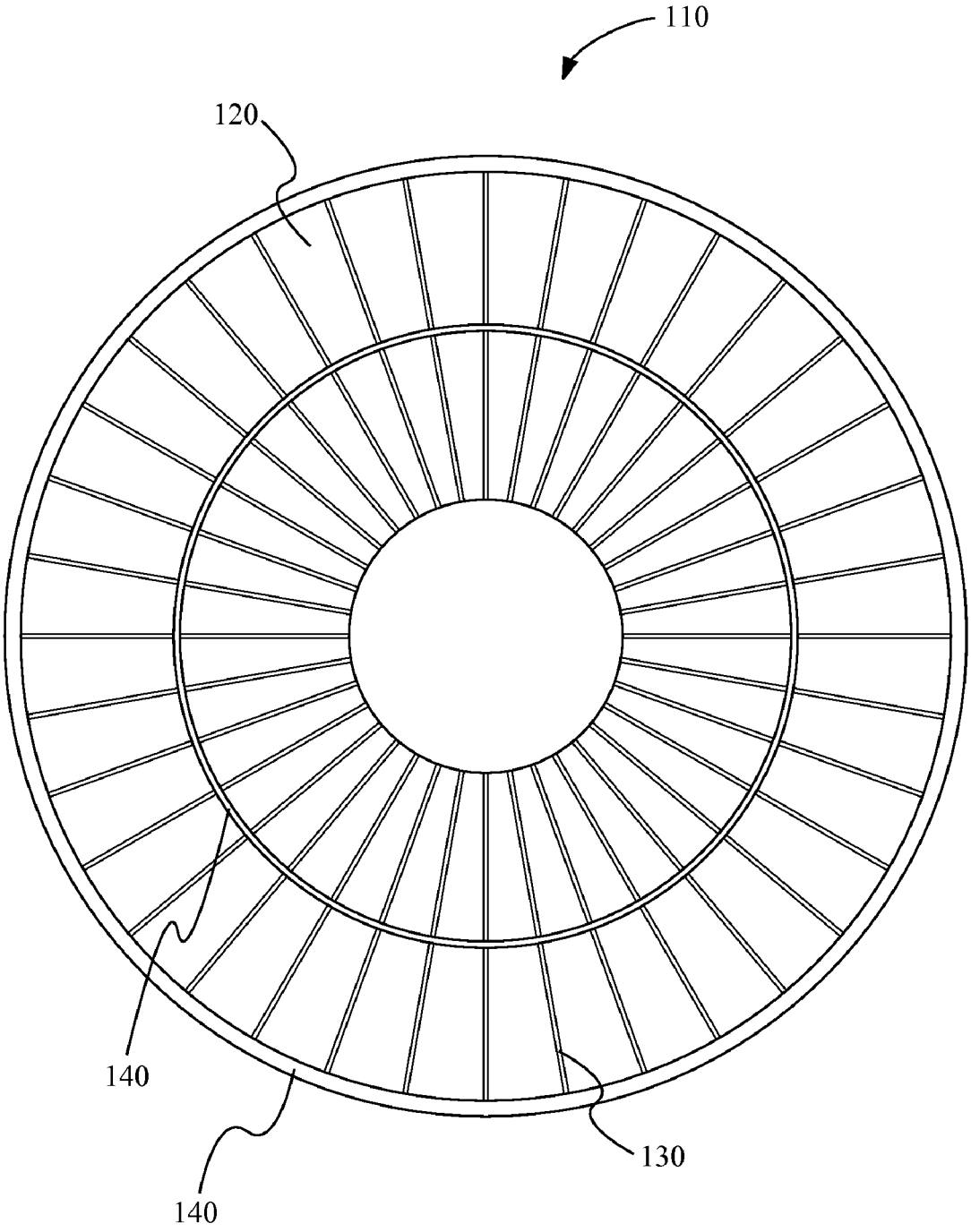
FIG. 16 shows a back view of a shape-memory reflector with two shape-memory stiffeners according to another embodiment.

In some embodiments, more than one shape-memory stiffener may be used as shown in FIGS. 15 and 16. FIG. 15 shows a three-dimensional and bottom view of a shape-memory reflector 110 with two shape-memory stiffeners 140 according to another embodiment. FIG. 16 shows a back view of a shape-memory reflector 110 with two circumferential shape-memory stiffeners 140 according to another embodiment. Moreover, multiple shape-memory stiffeners may be used.

Specific details are given in the above description to provide a thorough understanding of the embodiments. However, it is understood that the embodiments may be practiced without these specific details. For example, circuits, structures, and/or components may be shown in block diagrams in order not to obscure the embodiments in unnecessary detail. In other instances, well-known circuits, processes, algorithms, structures, components, and techniques may be shown without unnecessary detail in order to avoid obscuring the embodiments.

Also, it is noted that the embodiments may be described as a process, which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be rearranged. A process is terminated when its operations are completed, but could have additional steps not included in the figure. A process may correspond to a method, a function, a procedure, a subroutine, a subprogram, etc. When a process corresponds to a function, its termination corresponds to a return of the function to the calling function or the main function.

While the principles of the disclosure have been described above in connection with specific apparatuses and methods, this description is made only by way of example and not as limitation on the scope of the disclosure.

What is claimed is:

1. A shape-memory reflector comprising:

an elastic reflector material comprising a top surface and a bottom surface;

a shape-memory stiffener coupled with the elastic reflector material, wherein the shape-memory stiffener is configured in a band that encloses at least a portion of the elastic reflector surface; and a plurality of radial stiffeners coupled with the bottom surface of the elastic reflector material and extending radially from a central portion of the elastic reflector surface toward the outer edge of the elastic reflector surface, wherein the shape-memory reflector is configured to be packaged in a packaged configuration that includes a plurality of pleats within the elastic reflector material, and the shape-memory reflector is configured to deploy into the deployed configuration by heating the shape-memory stiffener to a temperature greater than a glass transition temperature of the shape-memory stiffener.

2. The shape-memory reflector according to claim 1, wherein the deployed configuration comprises a paraboloid.

3. The shape-memory reflector according to claim 1, wherein the shape-memory stiffener comprises a shape-memory polymer having a glass transition temperature that is less than a survival temperature of the shape-memory polymer.

4. The shape-memory reflector according to claim 1, wherein the shape-memory stiffener is coupled with the bottom surface of the elastic reflector material.

5. The shape-memory reflector according to claim 1, wherein the shape-memory stiffener comprises a composite panel including a first face sheet of elastic material, a second face sheet of elastic material, and a shape-memory polymer core sandwiched between the first face sheet and the second face sheet, wherein the first face sheet includes a portion of the elastic reflector material.

6. The shape-memory reflector according to claim 1, wherein the elastic reflector material includes a thin laminate material.

7. The shape-memory reflector according to claim 1, wherein the elastic reflector material includes a graphite composite material.

8. The shape-memory reflector according to claim 1, wherein the radial stiffeners comprise a solid material.

9. The shape-memory reflector according to claim 1, wherein the radial stiffeners comprise a laminate material.

10. The shape-memory reflector according to claim 1, wherein the shape-memory stiffener is coupled with the outer circumference of the elastic reflector material.

11. The shape-memory reflector according to claim 1, wherein the plurality of pleats in the elastic reflector material includes positive and negative pleats, wherein the peaks of the positive and negative pleats occur where the radial stiffeners are coupled with the elastic reflector material.

12. The shape-memory reflector according to claim 1, further comprising heaters coupled with the shape-memory stiffener.

13. The shape-memory reflector according to claim 1, further comprising a non-deployable reflector, wherein the non-deployable reflector is centrally located, the outer circumference of the non-deployable reflector is coupled with an inner radius of the elastic reflector material, and the redial stiffeners extend radially from near the inner radius of the elastic reflector material.

14. The shape-memory reflector according to claim 13, wherein the packaged configuration of the shape-memory reflector is configured such that the non-deployable reflector is not substantially shadowed by the shape-memory material in its packaged configuration, whereby the non-deployable reflector is useable without deployment of the shape-memory reflector.

15. A method for packaging a shape-memory reflector, wherein the shape-memory reflector is fabricated in a deployed configuration and includes a paraboloid-shaped elastic reflector coupled with a band of shape-memory stiffener at a circumference of the elastic reflector and a plurality of radial stiffeners, the method comprising:

heating the shape-memory stiffener to a temperature above the glass transition temperature of the shape-memory stiffener;

applying mechanical loads to the shape-memory reflector, wherein said mechanical loads deform the shape-memory reflector into a packaged configuration;

cooling the shape-memory stiffener to a temperature below the glass transition temperature of the shape-memory stiffener; and removing the mechanical loads.

16. The method according to claim 15, wherein the packaged configuration includes a plurality of pleats within the elastic reflector material.

17. The method according to claim 15, wherein the packaged configuration comprises a substantially cylindrical-shaped.

18. A method for deploying a shape-memory reflector, wherein the shape-memory reflector includes a paraboloid-shaped elastic reflector coupled with a shape-memory stiffener at a circumference of the elastic reflector and a plurality of radial stiffeners, and the shape-memory reflector is packaged in a packaged configuration, the method comprising:

heating the shape-memory stiffener to a temperature above the glass transition temperature of the shape-memory stiffener;

allowing the shape-memory reflector to return to a deployed configuration, wherein the deployed configuration comprises a paraboloid; and cooling the shape-memory stiffener to a temperature below the glass transition temperature of the shape-memory stiffener.

19. The method according to claim 18, further comprising mechanically actuating the radial stiffeners into a shape comprising a portion of a paraboloid.

20. The method according to claim 18, wherein the packaged configuration includes a plurality of pleats in the elastic reflector.

21. A method for manufacturing a paraboloid shape-memory reflector, the method comprising:

providing a thin elastic reflector material formed into a paraboloid, wherein the elastic reflector material includes a top surface at the concave side on the elastic reflector material and a bottom surface on the convex side of the elastic reflector material;

coupling radial stiffeners to the bottom surface of the elastic reflector material, wherein the radial stiffeners are positioned radially about the center of the elastic reflector material; and coupling a shape-memory stiffener with the elastic reflector material at a circumference of the elastic reflector material, wherein the circumference encloses at least a portion of the elastic reflector material centered about the center of the elastic reflector material.

* * * * *